United States Patent [19]

Henrich

[11] 4,447,214

[45] May 8, 1984

[54] ANTI-VENTILATION MEANS FOR MARINE GEAR CASE

[75] Inventor: Donald A. Henrich, Lake Villa, Ill.

[73] Assignee: Outboard Marine Corporation, Waukegan, Ill.

[21] Appl. No.: 348,035

[22] Filed: Feb. 11, 1982

[51] Int. Cl.[3] ..... B63H 1/20

[52] U.S. Cl. ..... 440/66; 440/89; 440/900; 440/73; 416/93 A

[58] Field of Search ..... 440/66, 73, 76–78, 440/89; 416/90 A, 93 R, 93 A, 93 M

[56] References Cited

U.S. PATENT DOCUMENTS

| | | | |
|---|---|---|---|
| 3,102,506 | 9/1963 | Kiekhaefer | 416/93 M |
| 3,554,665 | 1/1971 | Lorenz et al. | 416/93 A |
| 3,876,331 | 4/1975 | Den Herder et al. | 416/93 A |
| 4,180,368 | 12/1979 | Henrich et al. | 416/93 A |
| 4,295,835 | 10/1981 | Mapes et al. | 440/78 |
| 4,331,429 | 5/1982 | Koepsel et al. | 440/89 |

*Primary Examiner*—Trygve M. Blix
*Assistant Examiner*—Stephen P. Avila
*Attorney, Agent, or Firm*—Michael, Best & Friedrich

[57] ABSTRACT

The marine propulsion device includes a lower unit having a gear case normally submerged in water and arranged to discharge engine exhaust gas rearwardly from the rear end into the water exteriorly of the propeller hub. A ring member or thrust ring including a hub mounted on the propeller shaft for common therewith, an annular collar and a plurality of circumferentially-spaced, radially extending spokes or ribs interconnecting the annular collar and the hub serves as a fishline and weed cutter. The annular collar includes an annular outer surface which extends closely adjacent an annular inner surface in the interior of the gear case adjacent the trailing edge of the gear case. In one embodiment, forward migration of the engine exhaust gases along the outer surface of the gear case, which can cause unstable handling of the lower unit, is prevented by an anti-ventilation means including an annular section on the ring member collar located rearwardly of the annular outer surface and rearwardly of the trailing edge of the gear case and having an outer surface tapering radially outwardly from the outer surface of the gear case toward the propeller.

3 Claims, 3 Drawing Figures

ANTI-VENTILATION MEANS FOR MARINE GEAR CASE

BACKGROUND OF THE INVENTION

This invention relates to marine propulsion devices, such as outboard motors and stern drive units, including a gear case normally submerged in water and, more particularly in one aspect, to such marine propulsion devices including fishline and weed cutting means.

In one aspect, the invention is an improvement of the construction disclosed in the U.S. Henrich et al U.S. Pat. No. 4,180,368 issued Dec. 25, 1979. That patent discloses a marine propulsion device which is arranged to discharge engine exhaust gases from the rear end of the gear case into the water exteriorly of the propeller hub and includes a fishline and weed cutter mounted between the propeller and the aft end of the gear case.

Forward migration of exhaust gases being discharged into the water along the outer surface of the gear case has been found to cause unstable handling of the lower unit, particularly at higher boat speeds.

Attention is directed to the Mapes et al U.S. Pat. No. 4,295,835 issued Oct. 20, 1981.

SUMMARY OF THE INVENTION

The invention provides a marine propulsion device including a lower unit having a gear case normally submerged in water, a propeller shaft rotatably mounted in the gear case and having a rear portion which extends rearwardly of the trailing end of the gear case and carries a propeller having an outer hub, means defining a passage through which engine exhaust gases are discharged rearwardly from the interior of the gear case into the water exteriorly of the propeller hub, and an anti-ventilation means mounted for common rotation with the propeller shaft for preventing engine exhaust gases being discharged from the gear case from migrating forwardly along the outer surface of the gear case.

In one embodiment, the gear case terminates in a trailing surface and the interior has an annular inner surface adjacent the trailing surface and there is provided fishline and weed cutting means including a ring member which is mounted for common rotation with the propeller shaft and has an annular collar including an annular outer surface extending closely adjacent the annular inner surface of the gear case. The anti-ventilation means is an annular section on the collar rearwardly of the annular outer surface and rearwardly of the trailing surface of the gear case and has an outer surface tapering radially outwardly from the outer surface of the gear case toward the propeller.

One of the principal features of the invention is the provision of a marine propulsion device including a gear case normally submerged in water and simple, effective anti-ventilation means for preventing engine exhaust gases being discharged rearwardly from the gear case into the water from migrating forwardly along the outer surface of the gear case.

Another of the principal feature of the invention is the provision of a marine propulsion device including a gear case normally submerged in water, a fishline and weed cutter disposed between the trailing end of the gear case and the propeller, and anti-ventilation means on the fishline and weed cutter means for preventing engine exhaust gases being discharged rearwardly from the gear case into the water from migrating forwardly along the outer surface of the gear case.

Other features, aspects and advantages of the invention will become apparent to those skilled in the art upon reviewing the following detailed description, the drawing and the appended claims.

Figure 1:
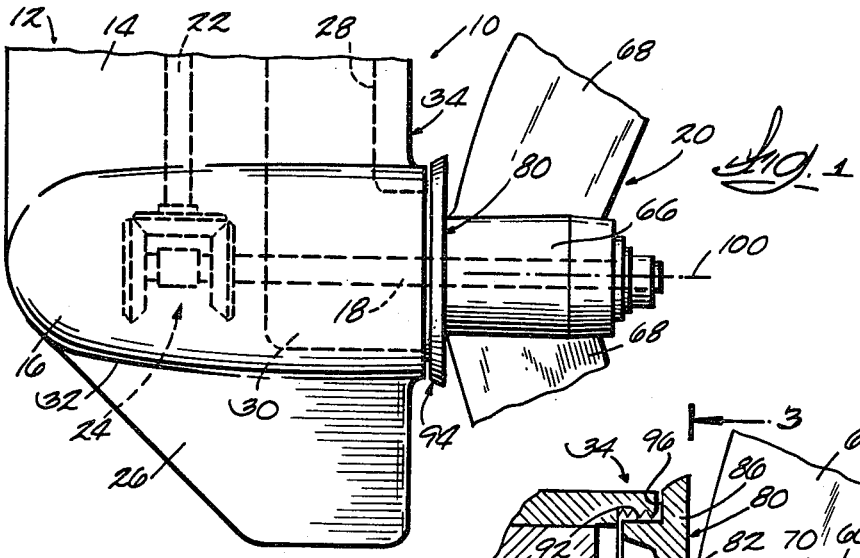
FIG. 1 is a fragmentary view of the lower unit of a marine propulsion device incorporating various of the features of the invention.

Before explaining at least one of the embodiments of the invention in detail, it is to be understood that the invention is not limited in its application to the details of construction and the arrangements of components set forth in the following description or illustrated in the drawing. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

Illustrated fragmentarily in FIG. 1 is a marine propulsion device 10, which can be either a stern drive unit or an outboard motor, including a propulsion or lower unit 12 having a driveshaft housing 14 and a gear case 16 which is normally submerged in water.

Rotatably mounted in the gear case 16 is a propeller shaft 18 carrying a propeller 20 rearwardly of the gear case 16. Extending through the driveshaft housing 14 transversely to the propeller shaft 18 is a rotatably mounted driveshaft 22 which at the upper end is operably connected to an internal combustion engine (not shown) and at the lower end is drivingly connected to the propeller shaft 18 through a conventional reversing clutch or transmission 24. Extending downwardly from the gear case 16 is a vertical fin or skeg 26.

Extending through the driveshaft housing 14 is an engine exhaust passage 28 which communicates with an exhaust gas discharge passageway 30 in the gear case 16. Engine exhaust gases are discharged into the water from the aft or rear end of the gear case 16 as explained in more detail below.

Figure 2:
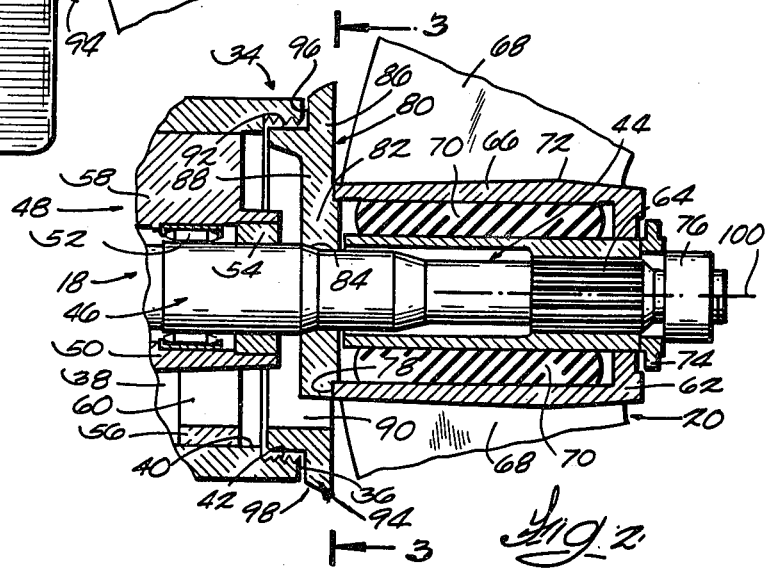
FIG. 2 is an enlarged, fragmentary, cross sectional view of the rear portion of the gear case and the propeller of the marine propulsion device of FIG. 1.
Figure 3:
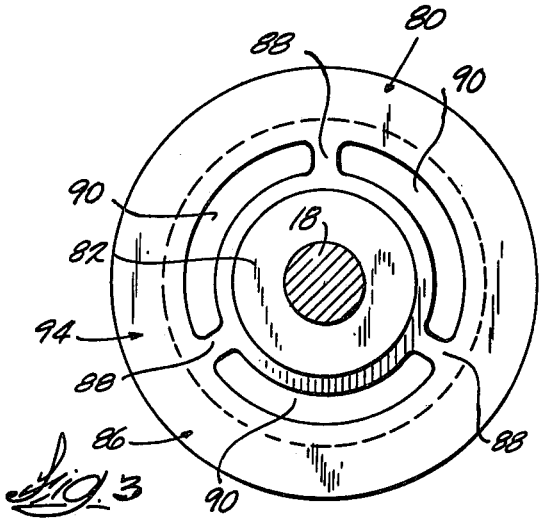
FIG. 3 is a view of the annular ring or thrust ring taken generally along line 3—3 in FIG. 2.

The gear case 16 has a streamlined or torpedo-shaped outer surface 32 and a trailing end portion 34 terminating in a rearwardly facing surface or edge 36. Referring to FIG. 2, the gear case 16 has a hollow interior 38 including at its rear a generally cylindrical portion 40 having an offset, cylindrical, annular inner surface 42 adjacent the trailing edge 36. The annular inner surface 42 has a series of circumferentially extending ribs or convolutions.

The propeller shaft 18 includes an aft or rear portion 44 extending rearwardly of the gear case 16 and a forward portion 46 rotatably supported inside the gear case 16 by a bearing retainer 48 suitably affixed to the interior of the gear case 16. The bearing retainer 48 preferably is constructed and mounted in the gear case 16 in the manner disclosed in the U.S. Henrich Pat. No. 4,180,368 which is incorporated herein by reference. The bearing retainer 48 includes a central hub portion 50 carrying a roller bearing 52 and lubricant seal 54. The bearing retainer 48 also includes an annular outer sleeve 56 engaging the interior of the gear case 16 and a plurality of circumferentially-spaced, radially extending spokes or ribs 58 interconnecting the hub 50 and the sleeve 56. The openings 60 defined between the ribs 58 are in communication with the exhaust gas discharge passageway 30 in the gear case 16 and serve as ports through which the engine exhaust gases are discharged rearwardly from the gear case 16 into the water.

The propeller 20 can be mounted on the propeller shaft 28 in any suitable manner, such as that disclosed in the U.S. Henrich Pat. No. 4,180,368, and includes an inner hub 62 mounted on the rear portion 44 of the propeller shaft 18 for common rotation therewith, such as by splines 64. The propeller 20 also includes an outer hub 66 carrying a series of blades 68 and connected to the inner hub 64 by a resilient member 70. The resilient member 70 is suitably connected or bonded to both the inner and outer hubs 62 and 66 so as to absorb shock and permit a limited amount of relative rotation between the inner and outer hubs 62 and 66. The outside diameter of the outer hub 66 is materially less than the inside diameter of the rear cylindrical portion 40 of the gear case 16 so that exhaust gases being discharged through the rear end of the gear case 16 flow rearwardly in area around the periphery or outer surface 72 of the outer hub 66.

The propeller 20 is retained on the propeller shaft 18 by suitable means, such as a washer 74 and a nut 76 threaded onto the aft or rear end of the propeller shaft 18.

Located adjacent the forward end 78 of the outer propeller hub 66 is a ring member or thrust ring 80 including a central hub 82 arranged to receive a conical, thrust-bearing surface 84 on the rear portion 44 of the propeller shaft 18. The thrust ring 80 includes an annular collar 86 connected to the hub 82 by a plurality of circumferentially-spaced, radially extending spokes or ribs 88. Engine exhaust gases being discharged rearwardly from the gear case 16 pass through the openings 90 between the ribs 88.

When the propeller 20 is being driven for forward movement, forward thrust is transmitted from the outer hub 66, through the thrust ring 80 and to the propeller shaft 18. This causes a thrust ring hub 82 to move into tight engagement with the thrust bearing surface 84 and the thrust ring 80 rotates along with the propeller 20 and the outer hub 66. The rapidly rotating thrust ring ribs 88 serve to cut and/or shread fishline, weeds and other foreign matter in the vicinity of the aft end of the gear case 16. The exhaust gases being discharged rearwardly from the gear case 16 through openings 60 and 90 provided by the bearing retainer 48 and the thrust ring 80, respectively, aid in carrying communited and shreaded fishline, weeds and other foreign matter away from the propeller blades 68.

The collar 86 of the thrust ring 80 includes a cylindrical, annular outer surface 92 which is located in telescopic relationship with and extends closely adjacent to the inner annular surface 42 of the gear case 16 and wipes the outer surfaces of the convolutions to prevent the escape of exhaust gases therebetween and the entry of fishline, weeds and foreign materials into the gear case 16.

Forward migration of exhaust gases being discharged from the gear case along the outer surface 32 of the gear case 16 can cause unstable handling of the propulsion unit 12, particularly at higher boat speeds. Anti-ventilation means mounted for common rotation with the propeller shaft 18 is provided for preventing these exhaust gases from migrating forwardly. In the specific embodiment illustrated, the anti-ventilation means comprises an annular section 94 on the collar 86 located rearwardly of the annular outer surface 92 and having a forward edge or surface 96 closely spaced from the trailing edge 36 of the gear case 16. The section 94 has an outer surface 98 which tapers radially outwardly from the outer surface 32 of the gear case 16 toward the propeller 20. While the outer surface 98 of the section 96 can have various configurations, it preferably is generally concave with respect to the rotational axis 100 of the propeller shaft 18.

In addition to serving as a barrier for preventing forward migration of exhaust gases, the section 94 tends to deflect fishline, weeds and other foreign matter outwardly away from the propeller 20. Furthermore, by virtue of rotating at a relatively high speed, the section 94 produces a pressure condition in the vicinity of the trailing end 34 of the gear case 16 tending to assist in dislodging fishline, weeds and foreign matter from the gear case 16.

Various of the features of the invention are set forth in the following claims.

I claim:

1. A marine propulsion device including a lower unit including a gear case normally submerged in water and having an outer surface, a trailing end terminating in a trailing surface, and a hollow interior having an annular inner surface adjacent said trailing surface, a propeller shaft rotatably supported in said gear case and having a rear portion extending rearwardly of the trailing end of said gear case, a propeller mounted on the rear portion of said propeller shaft for common rotation therewith and having an outer hub, means defining a passage through which engine exhaust gases are discharged rearwardly from said interior of said gear case into the water exteriorly of said outer propeller hub, a ring member having a central hub mounted on said propeller shaft for common rotation therewith, a plurality of circumferentially-spaced ribs extending radially from said central hub, and an annular collar connected to said ribs and including an annular outer surface extending closely adjacent said annular inner surface of said gear case, and an annular section on said collar located rearwardly of said annular outer surface and rearwardly of said trailing surface of said gear case, said section having an outer surface tapering radially outwardly from the outer surface of said gear case towards said propeller so as to prevent migration forwardly along the outer surface of said gear case of engine exhaust gases discharged from said gear case.

2. A marine propulsion device according to claim 1 wherein said annular section has a forward edge closely spaced from said trailing surface of said gear case.

3. A marine propulsion device according to claim 1 wherein the outer surface of said annular section is concave with respect to the rotational axis of said propeller shaft.

* * * * *